United States Patent [19]

Serratto

[11] 4,047,662

[45] Sept. 13, 1977

[54] TERMINAL UNIT FOR THE OUTLET OF CONDITIONED AIR IN A CENTRALIZED CONDITIONING SYSTEM

[76] Inventor: Angelo Serratto, Corso Indipendenza, 5, Milan, Italy

[21] Appl. No.: 639,981

[22] Filed: Dec. 11, 1975

[30] Foreign Application Priority Data

Dec. 11, 1974 Italy ..... 30453/74

[51] Int. Cl.[2] ..... F24F 13/06

[52] U.S. Cl. ..... 236/49; 165/40; 236/80 R

[58] Field of Search ..... 236/49, 80 R, DIG. 19; 165/40; 62/186

[56] References Cited

U.S. PATENT DOCUMENTS

| | | | |
|---|---|---|---|
| 2,537,315 | 1/1951 | Newton | 236/49 X |
| 3,743,180 | 7/1973 | Perkins et al. | 236/49 X |
| 3,790,075 | 2/1974 | Rifkin et al. | 236/49 |
| 3,913,832 | 10/1975 | Dean, Jr. | 236/49 |

*Primary Examiner*—William E. Wayner

*Assistant Examiner*—William E. Tapolcai, Jr.

*Attorney, Agent, or Firm*—Rose & Edell

[57] ABSTRACT

A variable flow, modular-type terminal unit for conditioning rooms in a centralized conditioning system is provided with means for controlling the conditioned air flow arranged within the outlet diffuser in order to vary the cross-section area of the outlet ports, being operated by a thermostatic device. The thermostatic device, directly fed with conditioned air operates such controlling means through a control lever, a control rod displaceable in the direction of its length and a triangular lever hinged at one vertex for rotation in a plane parallel to that where the control lever is pivotedly mounted. The operating member of the thermostatic device engages the control lever through the end of a threaded rod adjustable for setting the operation temperature. Other two adjusting screws are provided for hand control of the maximum and minimum cross-section opening of the diffuser outlet ports, by limiting the control lever rotation in two opposite directions.

13 Claims, 6 Drawing Figures

TERMINAL UNIT FOR THE OUTLET OF CONDITIONED AIR IN A CENTRALIZED CONDITIONING SYSTEM

BACKGROUND OF THE INVENTION

The present invention relates to a terminal unit for the outlet of conditioned air in a centralized conditioning system.

Units of the above-mentioned kind are well known, which are generally mounted to the celling of a room to be conditioned, completely or partially in view, as there is provided a false ceiling wherefrom they project with their end being the outlet of conditioned air. These terminal units can be divided into two basic types: the centralized terminal units and the modular terminal units. The centralized terminal units are those which are useful to the conditioning of rooms of larger volume than the rooms which can be conditioned by a modular terminal unit. The centralized terminal units require in fact a network of air distributing conduits and air outlets for flowing into the room. The modular terminal units on the contrary are more complex, as they comprise in a single assembly the usual deadening devices, flow control devices and the conditioned air outlet nozzles.

In these cases such terminal units are connected to the centralized system by feeding pipes from which they receive conveniently filtered, heated or cooled, humidified or dehumidified air. Such systems are at present of two basic types, namely systems known as "all-air" systems and mixed "air-water" systems. The difference between the two types of system stands in the fact that with the mixed type systems there are provided in the room to be conditioned air treatment units comprising heat-exchangers through which heated or cooled water flows, such as to cause water sensible heat to be transmitted to or subtracted from the conditioned room.

The terminal unit according to the present invention, may be applied to both the above-mentioned types of system and in particular it is a variable flow modular-type terminal unit, thus being sufficient by itself only to provide to the conditioning of a room. As it is known, such conditioning is a function of a number of parameters, among which the type of room to be conditioned is mainly important. As a matter of fact there are peripheric and central rooms. Peripheric rooms are considered those in contact with the outside through the building outside main walls and the ceiling, thus having temperature and humidity influenced not only by internal variations, but also by modification of the external climate. Central rooms are considered those which are only influenced by internal thermic weight variations, caused by the persons in the room, lighting, electromechanical apparatus, etc. In both cases the thermic weight is always extremely variable, either when heat has to be brought or removed in order to keep constant the room temperature.

This purpose is achieved, in the known terminal units, by varying the flow quantity of conditioned air fed into the room, according to the temperature variations, whereby it is provided to modify the passage cross-section of the conditioned air in a zome upstream of the air outlet, the cross-section of which cannot be varied. With terminal units of this type the conditioning is satisfactory only for flow quantitites being the maximum flow or very near to the maximum, whereas it becomes quickly unsatisfactory when, due to a flow reduction, a consequent reduction of air outflow speed occurs. In order to obviate this drawback it has been designed to utilize the so-called "wall" effect, i.e. the phenomenon according to which, upon blowing air parallel to the horizontal surface of a ceiling, air itself stays for some time near the ceiling. A first drawback of this solution is due to the fact that, if air entering the room has a lower temperature, the density difference causes air to descend and, below a certain value of inflow speed, the layer of air, temporarily adhering to the ceiling, runs downwards giving rise to dangerous and annoying cool downdraughts. Air flow given by such units is therefore seldom less than 50% of the maximum flow.

Another drawback of such solution results from the fact that, if the temperature of entering air is higher than room temperature, a flow reduction and therefore a speed reduction causes an emphasizdd stagnation phenomenon with sensible temperature differences at the various heights in the room and upwards increasing temperatures. Sometimes, in the same room, differences of 5° -6° C may occur, from the ceiling to about half height of the room. In addition, at the ceiling there are provided room air intake devices. It is clear that such devices cause air at the highest temperature in the room to be sucked, with consequent loss of thermic energy. A further drawback shown by the known terminal units results from the fact that, to utilize at the most the above mentioned "wall" effect, it is necessary to provide a false ceiling, the lower surface of which, facing to the room, is positioned flush with the terminal unit outlet. This renders more complicated the manufacture of room ceilings and in addition more difficult the routine maintenance of the conditioning systems as, for the access to the terminal units, it is necessary to remove the false ceiling. Furthermore the latter must be completely smooth, without projections, since a protruding part would cause air flow to be diverted downwards thus giving rise to out-of-control air streams, which would affect the thermic conditions within the room, thus rendering extremely difficult a correct control of the conditioning.

A further drawback shown by the known terminal units is that resulting from the delay with which such units respond to abrupt pressure variations of the fed air in consequence of flow reductions of other terminal units situated in other rooms. The thermostat usually provided in such units has in fact a time of intervention that may be exceedingly long, during which the room temeperature greatly differs from a predetermined value.

Still another drawback shown by the known terminal units derives from the considerable maintenance required upon installation for setting and regulation operations, with a need for a frequent employment of specialized operators.

Yeat a further drawback of the known terminal units is that of having, at every operational condition, an induction ratio with respect to room air which is sufficient to utilize conditioned air with temperatures substantially different from room air and therefore to increase the necessary volume of conditioned air.

SUMMARY OF THE INVENTION

It is an object of the present invention to provide a terminal unit for the outlet of conditioned air in a centralized conditioning system of the modular type with variable flow, which allows to obviate the above cited drawbacks shown by the known units.

It is an object of the invention to provide a terminal unit wherein the outflow speed of the conditioned air is kept constant when air flow varies at constant pressure in the feed conduits from the centralized system. This has proved to be very important in relation to the fact that air movement within the conditioned room is not subjected to variations and such movement itself contributes with temperature and humidity, to form the "actual temperature" which is that perceived by a human body.

It is another object of the invention to provide a terminal unit wherein the possibility of air outflow speed being constant is obtained in condition of either maximum or minimum flow entity, thus being possible to utilize at the most the performances of the terminal unit itself.

It is a further object of the present invention to provide a terminal unit having a response time to abrupt variations of fed air, greatly reduced with respect to the response times of the known type terminal units.

Finally it is to be noted that variable flow conditioning systems are generally used to remove heat, whereby in the following description the temperature of air fed through the terminal unit of the present invention is assumed to be always lower than the room termperature.

The terminal unit of the present invention for the outlet of conditioned air in a centralized conditioning system, comprising an outlet diffuser of conditioned air connected with a conditioning station, means for controlling conditioned air flow operated by a thermostatic device, is characterized by the fact that the conditioned air flow controlling means is positioned within the diffuser and is arranged to vary the outlet port therof, and the fact of comprising a device for conveying conditioned air directly to the thermostatic device and means for actuating said conveyer device at a predetermined pressure of conditioned air, measured inside the diffuser.

BRIEF DESCRIPTION OF THE DRAWINGS

The objects and the features of the terminal unit according to the invention will be fully explained from the following description of an embodiment thereof, given by way of example with reference to the annexed drawings, in which.

DETAILED DESCRIPTION OF THE PREFERRED EMBODIMENT

Figure 1:
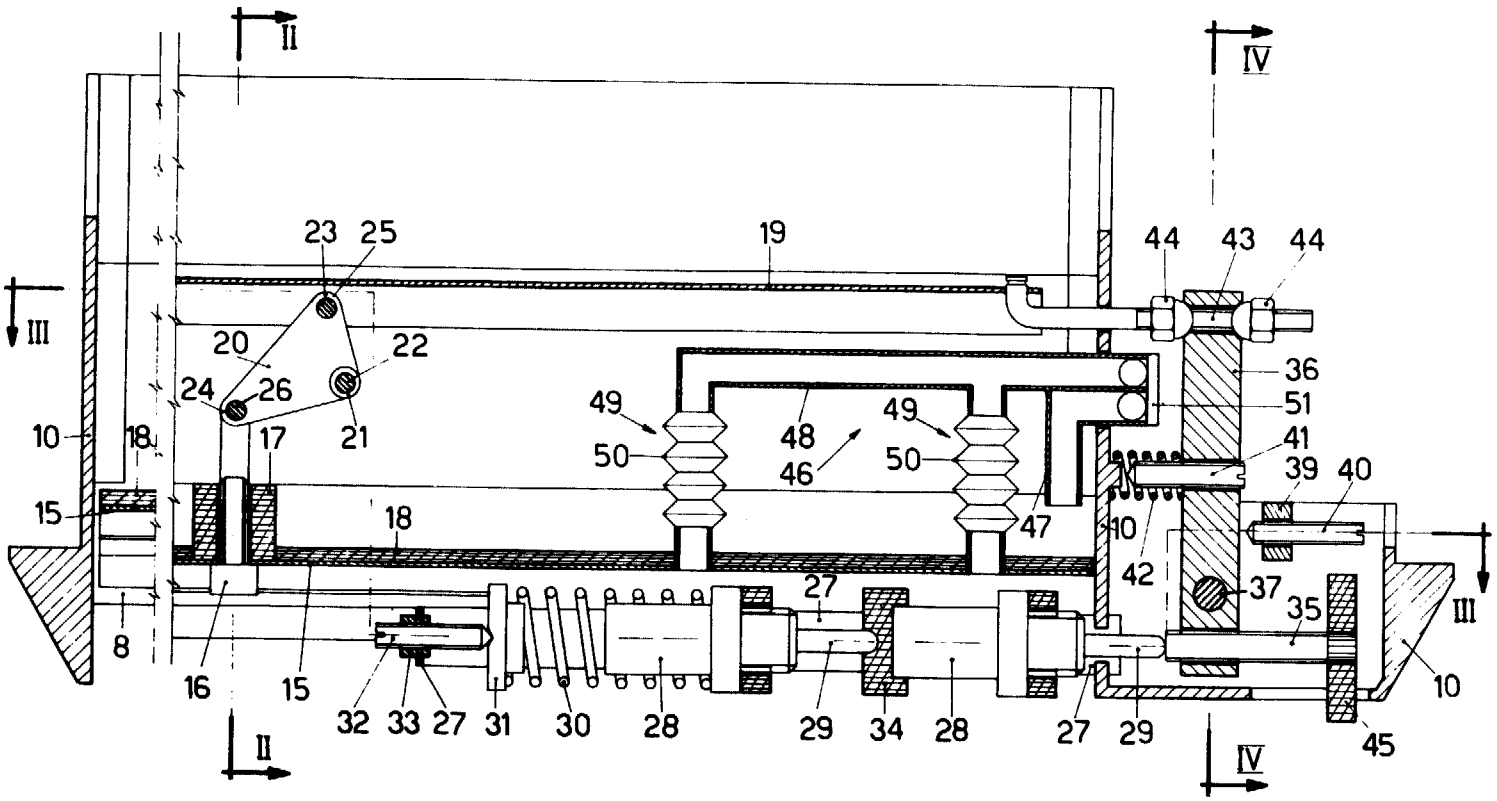
FIG. 1 is a cross-sectional view of the terminal unit of the invention.
Figure 2:
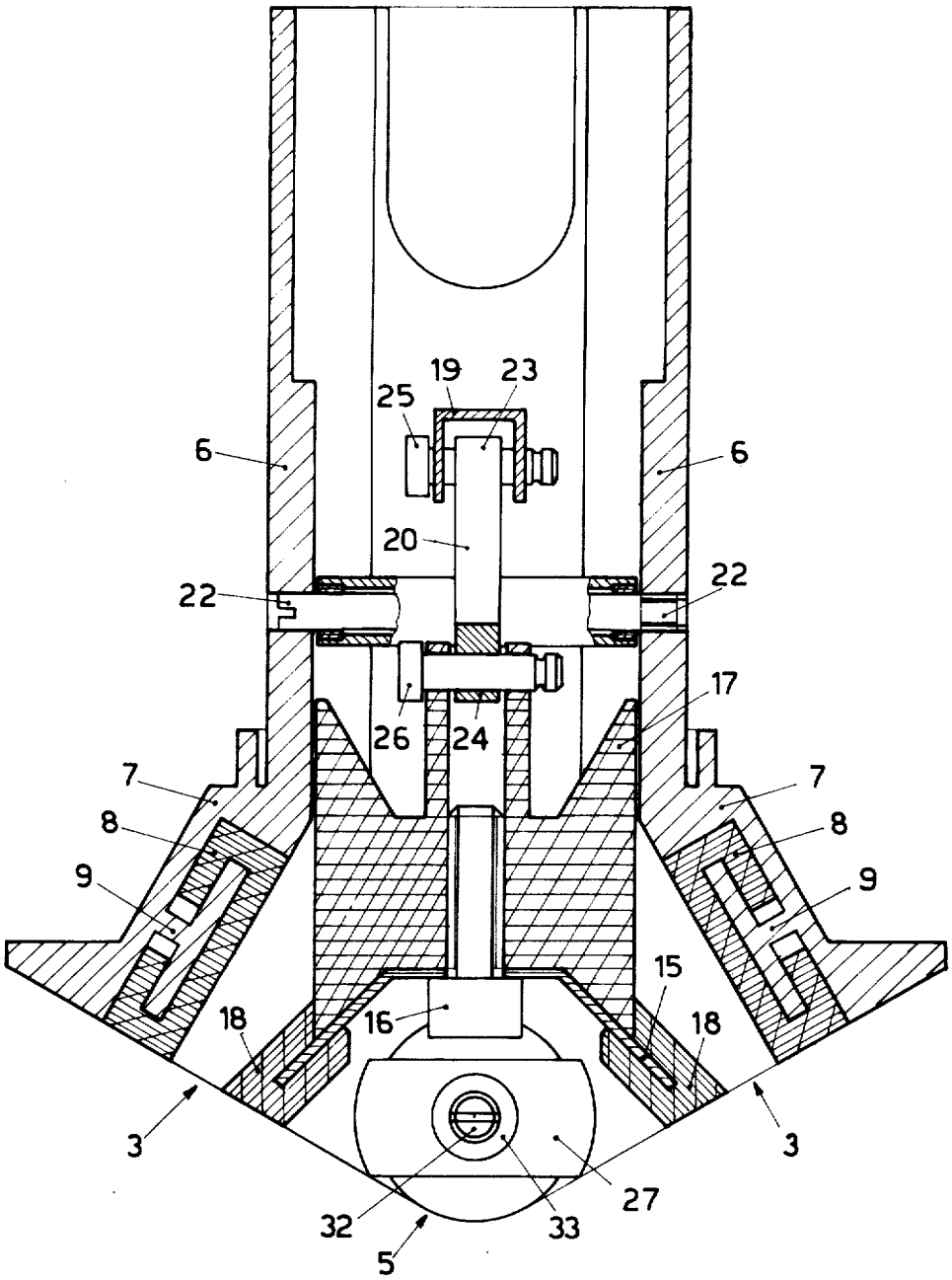
FIG. 2 is a view of the terminal unit along cross-section II—II of FIG. 1.
Figure 5:
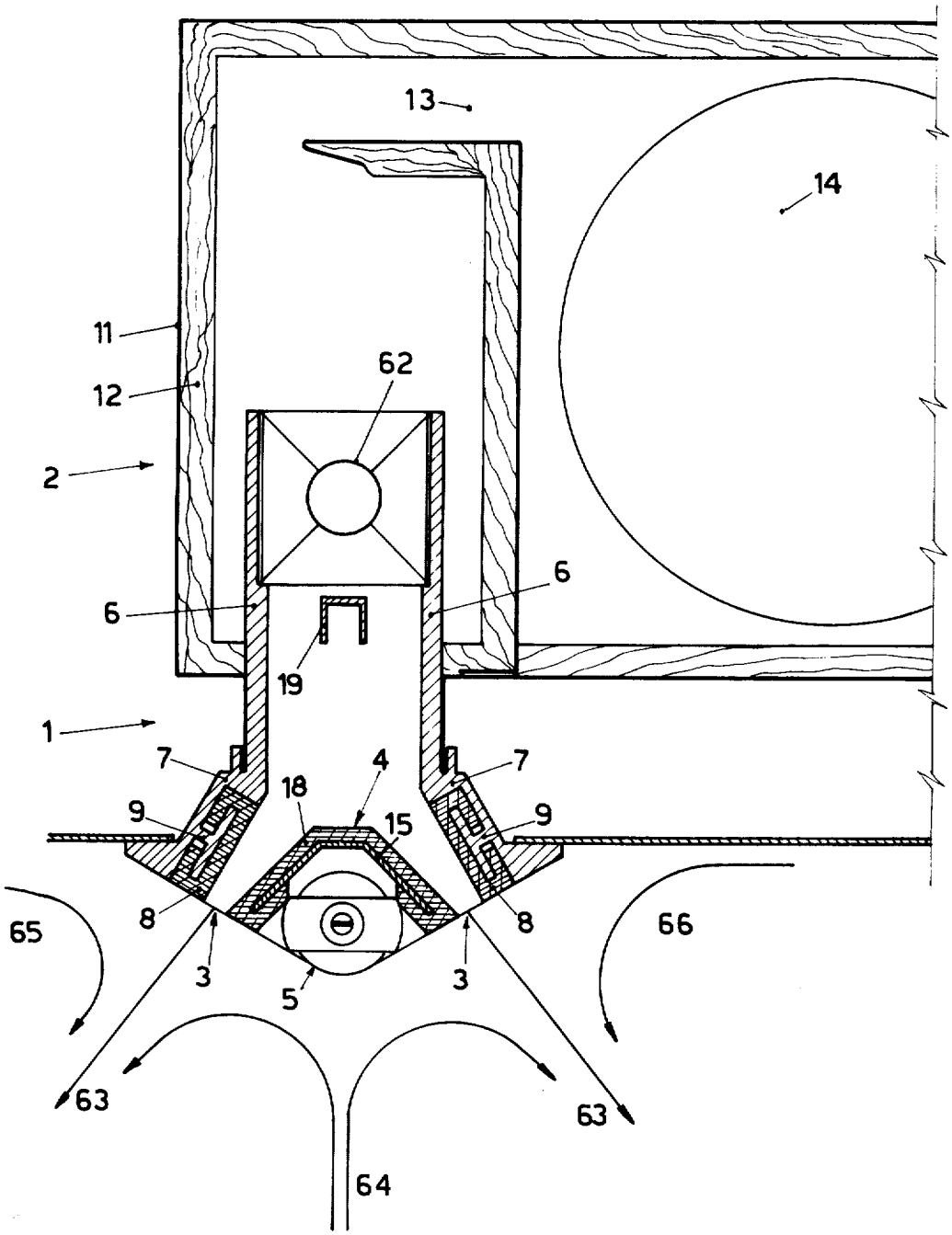
FIG. 5 is a diagrammatic cross-section view of the terminal unit and associate feeding pipes.

With particular reference to FIGS. 1, 2 and 5 the terminal unit of the present invention comprises a diffuser 1 communicating at an end with usual feeding pipes 2 and at the other end provided with air conditioned outlet ports 3. The terminal unit also comprises a means 4 for controlling conditioned air flow and a thermostatic device 5 actuating flow control means 4. Diffuser 1 comprises two parallel walls 6, each being formed in the part facing to the room with a bent portion 7 at angle of e.g. 30° %, with a vertical axis, so as to form a conduit diverging in the direction towards the outlet ports 3. Each portion 7 has on its inner face a gasket 8 of rubber or the like, substantially C-shaped, fixed to a substantially T-shaped protrusion of portion 7. At the ends of portions 7 there are provided two clamping plates 10 adapted to keep in any known manner the portions 7 at a prefixed distance. The walls 6 of diffuser 1 are fixed inside a chamber formed in a feeding pipe 11, generally known as "plenum chamber", wherein the inlet end of diffuser 1 is positioned. Plenum chamber 11 is innerly lined with a thermo-insulating and soundproofing material 12, and is provided with a known per se deadening labyrinth 13. With 14 a usual connecting element of the plenum chamber 11 to the conditioning station has been indicated. According to the preferred embodiment the walls 6 of diffuser 1 are made of extruded aluminium. The means 4 for controlling conditioned air flow comprises a substantially V-shaped metal section 15 having a length slightly lower than walls 6 and with a flat base placed at right angles to the conditioning air flow direction through walls 6. Metal section 15 is fixed, by screw 16, to two support members 17, only one of which is shown in the annexed drawings, which are provided to guide metal section 15 along an axis parallel to the longitudinal median axis of diffuser 1.

As it can be noted in particular in FIGS. 2 and 5 the inclined walls of metal section 15 form with the longitudinal median axis of the diffuser 1 an angle wider than that between portions 7 and the same axis, whereby the outlet ports 3 of the diffuser 1 show a decreasing cross-section towards the outlet. According to a preferred embodiment the angle between the inclined walls of metal section 15 and the longitudinal median axis of diffuser 1 is of 45°. Metal section 15 is completely covered with a rubber coating element 18 or the like, both at the side facing to the outlet ports 3 and at the side facing the thermostatic device 5. Metal section 15 forms therefore a plugging device, movable upwards or downwards, thus suitable to modify the outlet cross-section of the ports 3 according to the required flow variations. Within diffuser 1 there is also provided a means to cause to sliding upwards or downwards of the metal section 15, comprising an actuating rod 19, connected by two levers 20 (only on of which represented in the annexed drawings) to the guiding and support members 17. The actuating rod 19 consists of a C-shaped metal section, placed parallel to walls 6, equidistant therefrom and facing its concavity towards the outlet of diffuser 1. The levers 20 consist of substantially triangular plates having a vertex 21 hinged on a pivot 22 with the ends fixed to the walls 6 and the remainder two vertices 23 and 24 hinged respectively on a pin 25 fixed to the support and guide member 17.

Figure 3:
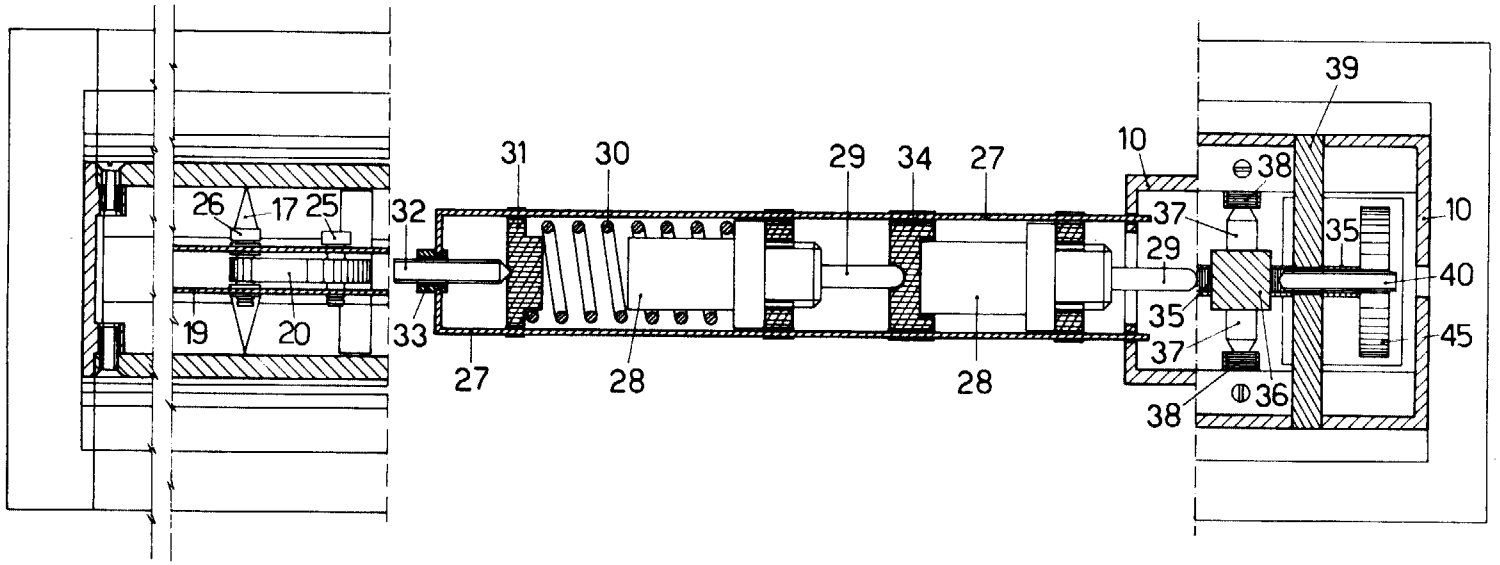
FIG. 3 is a view of the terminal unit along cross-section III—III of FIG. 1.

With particular reference to FIGS. 1, 2 and 3, the thermostatic device 5 is positioned under the diffuser 1, in a central zone, within the hollow defined by metal section 15. The thermostatic device 5 comprises, in a metallic housing body 27, two thermostatic elements 28, arranged in series, of the type consisting of a cylinder including a wax-based mixture and a piston 29 the sliding of which within the cylinder is controlled according to the softening degree of the wax-based mixture. Inside the housing body 27 there is also provided a spring 30 wound at an end around the cylinder of one of the two thermostatic elements 28, while the other end is in contact with a spring pressing disc 31, hold against the spring 30 through an adjusting screw 32 which is screwed within a sleeve 33 fixed to the housing body 27. The piston 29 of the thermostatic element 28 on which the spring 30 is wound, comes into abutment with a connecting member 34 at the opposite face of which the base of the other thermostatic element 28 is fitted. As in particular is shown in FIG. 3, the housing body 27 is fixed to one of the clamping members 10, so as to stay in a stationary position with respect to portion 7 of the walls 6. Piston 29 of the thermostatic element 28, protruding from the housing body 27, is in engagement with a threaded rod 35 passing throughout an end of an actuating lever 36 rotatably mounted about a pin 37 with its ends clamped inside supports 38 which are fixed to the clamping member 10. The threaded rod 35 is provided with a control handwheel 45 for controlling the stroke of the piston 29 of the thermostatic element 28. On the upper side of the threaded rod 35, on a support fixed to the clamping member 10, a screw 40 is provided for adjusting the minimum opening of the outlet ports 3 of diffuser 1. The adjusting screw 40 is therefore suitable to limit the clockwise rotation of the control lever 36. On the control lever 36, in an intermediate zone, another adjusting scew 41 is provided for controlling the minimum opening of the outlet ports 3 of diffuser 1. The adjusting screw 41 is adapted to engage with the clamping member 10 and between this and the control lever 36 there is positioned a spring 42 for carrying back the control lever 36 to the original position when a variation of the outlet cross-section of the ports 3 occurs. The control lever 36, at its upper end, is provided with a tie rod 43, connected with rod 19, which is fixed to the control lever 36 by means of stop nuts 44 being cup-headed to give rise to an articulated linkage of the ball-joint type allowing at the same time the control lever 36 rotation and the tie rod rectilinear movement. The adjusting screws 32, 40, 41 are to be used during the initial setting of the terminal unit, to be carried out only one time, while the threaded rod 35 is useful to obtain a variation of the temperature of the conditioned air supplied by the terminal unit, by modifying the operational conditions of the thermostatic device 5. In fact, at each variation of temperature above or below the value preset by adjusting the handwheel 45, pistons 29 of the thermostatic elements 28 move forward or backward, such movement being counterbalanced by the threaded rod 35, thus causing a counterclockwise or clockwise rotation of the control lever 36 around the pin 37, what results, due to the action of the tie rod 43, in a horizontal displacment of the control rod 19 and therefore a downwards or upwards movement of the conditioned air flow control means 4, and consenquently an enlargement or a restriction of the opening of te outlet ports 3 of diffuser 1. When the flow control means is in a condition of maximum opening, if pistons 29 tend to further project outwards from the thermostatic elements 28, the spring 30 takes up such further stroke.

With reference in particular to FIG. 1 the terminal unit according to the invention comprises a device 46 for directly conveying conditioned air to the thermostatic elements 28. This conveyer device 46 comprises a conditioned air inlet duct 47 with its inlet end positioned inside diffuser 1 and a conditioned air outlet duct 48 divided into two branches 49 both terminating with the outlet end in front of the thermostatic elements 28. The end zone of the branches 49 is fixed to the metal section 15 of flow control means 4 and is connected to the outlet duct 48 through bellows elements 50 adapted to balance the relative movement of metal section 15 with respect to the outlet duct 48.

Figure 6:
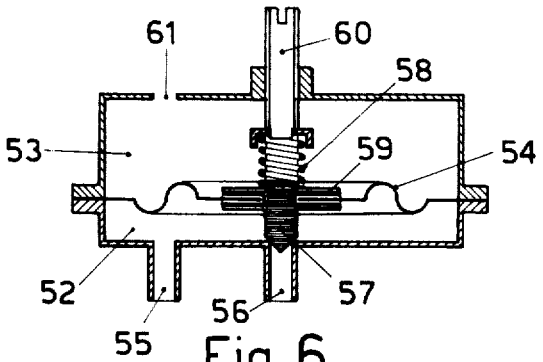
FIG. 6 is a cross-sectional view of the device for the actuation of the conveyer device.
Figure 4:
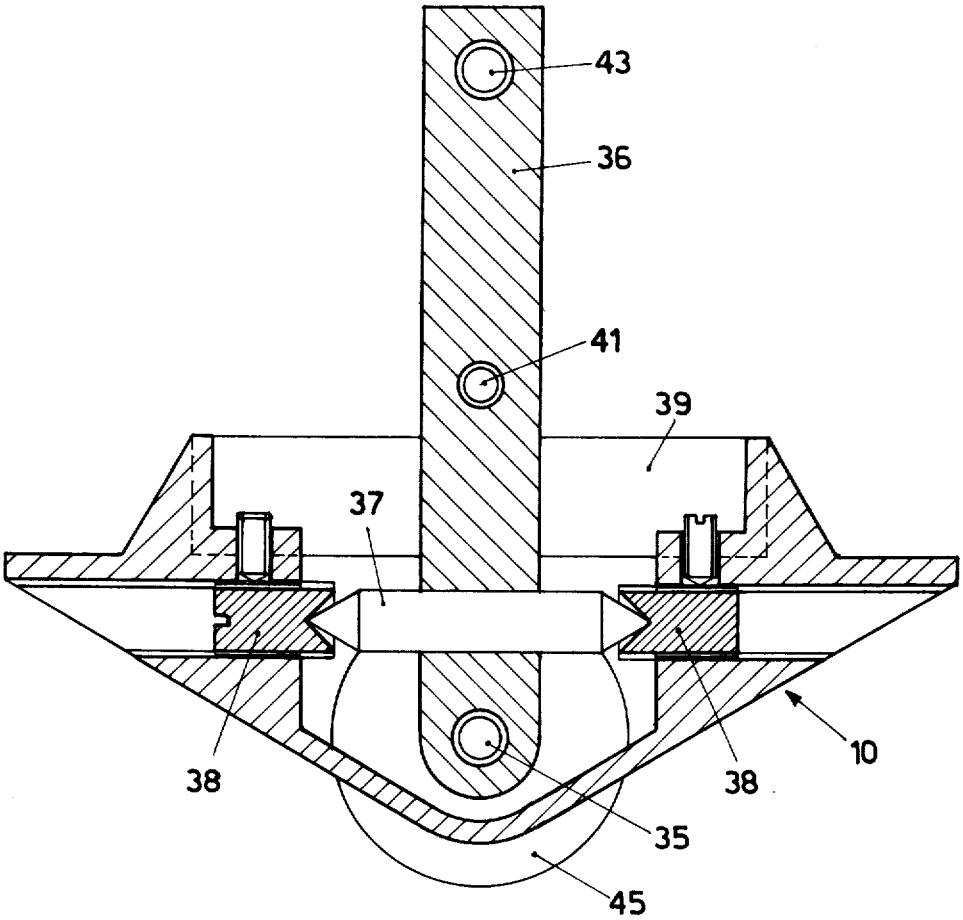
FIG. 4 is a view of the terminal unit along cross-section IV—IV of FIG. 1.

Between the outlet duct 48 and the inlet duct 47 a pressure switch 51 is provided, shown in detail in FIG. 6. With reference to this figure, the pressure switch comprises a first chamber 52 and a second chamber 53 with a resilient membrane 54 therebetween.

The first chamber 52 is provided with an inlet duct 55 and an outlet duct 56, the latter closed by a shutter means 57 kept in a closed position by a pressure spring 58 co-operating with a disc member 59 provided to hold the resilient membrane 54 in the position corresponding to the duct 56 being closed. There is also provided an adjusting screw 60 for controlling the pressure exerted by the spring 58. The second chamber 53 is in communication with the atmosphere through a hole 61. The inlet duct 55 is connected to the inlet duct 47, while the outlet duct 56 is connected to the outlet duct 48: the connections may be effected in any suitable known manner.

The conditioned air intaken through the inlet duct 47 is substantially at the same pressure as from the conditioning station. Upon a sudden variation of said pressure, in particular an increase for example because of an interruption of air delivery from the other terminal units, the resilient membrane 54 is subject to such a deformation as to overcome the action of pressure spring 58, thus allowing shutter means 57 to disengage from the outlet duct 56, so as air from inlet duct 55 can flow out through the outlet duct 56 and, through the duct 48, the bellows members 50 and the end zone of outlet duct 48, directly reach thermostatic elements 28. Such air, generally much colder than that flowing out from the diffuser 1, causes an immediate variation of the operational conditions of the thermostatic element 28, thus abruptly cooling the wax mixture contained in the thermostatic elements 28 and consenquently causing a backstroke of the piston 29. Conditioned air flow control means, through the linkages illustrated above, assumes the condition of minimum opening, until the above-cited conditions of excessive increase of the pressure are over. In such step the pressure switch is off and cooled air is no more fed to the thermostatic elements 28 through ducts 48, 49.

With particular reference to FIG. 5, a finned tube 62 is positioned at the upper portion of diffuser 1, throughout which heated water passes, or an electric resistance is provided for air heating. For the heating control a known microswitch is provided, which for a given position of the flow controlling means at the position of minimum flow, opens a solenoid-valve at the inlet of water into the finned tube or actuates an electromagnetic switch for feeding the resistance. Alternatively it is possible to provide a hydraulic valve directly controlled by control lever 36. This arrangement not forming part of the inventive scope of the subject terminal unit, will not be illustrated.

Still with particular reference to FIG. 5 there is represented the direction of air flows resulting from the use of the subject terminal unit. With 63 are designated the flows from outlet ports 3, which form an angle of about 30° to a horizontal line and do not require, to diffuse throughout the room the "wall" effect, thus forming three induced air streams, namely an upwards vertical central stream 64 and two lateral converging horizontal streams 65, 66. This phenomenon causes a rapid complete mixing of fed air with air already in the room thus rendering possible high temperature differences with a sensible flow reduction in comparison with that necessary in the known terminal units. The reduction of the outlet cross-section of ports 3, as well as the contemporary reduction of the conditioned air flow allow to obtain a constant feeding pressure in the plenum chamber 11, a constant outflow speed, and consequently also the induction effect, it is possible therefore to strongly reduce the minimum flow with respect to the maximum.

Varaiation and/or additions can be effected into the terminal units as above described and illustrated in the annexed drawings without therefor exceeding from the protective scope of the present invention as defined by the appended claims.

What I claim is:

1. A terminal unit for the outlet of conditioned air in a centralized conditioning system, comprising a diffuser of conditioned air through outlet ports connected with a conditioning station and means for controlling conditioned air flow operated by a thermostatic device, wherein said conditioned air flow controlling means is positioned within the diffuser and is arranged to vary the outlet ports thereof, further comprising a device for conveying conditioned air directly to the thermostatic device and means for actuating the conveyer device at a predetermined pressure of conditioned air.

2. A terminal unit according to claim 1, wherein the diffuser comprises two walls with a portion mutually parallel and a bent portion diverging at the conditioned air outlet port.

3. A terminal unit according to claim 2, wherein the conditioned air flow control means consists of substantially V-shaped metal section positioned at the outlet port of the conditioned air from the diffuser, the inclined walls of which define at the downside a hollow space and form with the inner face of the bent portion of said two walls a conduit converging in the outflow direction of the conditioned air, said metal section being connnected to lifting and lowering means controlled by said thermostatic device.

4. A terminal unit according to claim 3, wherein said means for lifting and lowering the metal section comprises a control rod arranged parallel to said diffuser walls, equidistant therefrom, movable in a direction perpendicular to the flow direction of the conditioned air in the diffuser, and connected to said metal section through at leat a pair of levers each having the fulcrum fixed to the same walls.

5. A terminal unit according to claim 4, wherein the thermostatic device is connected to the means for lifting and lowering said metal section through a control lever rotatably mounted in a plane parallel to the direction of movement of said control rod.

6. A terminal unit according to claim 5, wherein said control lever, at the end where it engages the thermostatic device is provided with a threaded rod pasing therethrough for setting the operation temperature, while at the side facing to the opposite end, it has a screw also passing therethrough for adjusting the maximum opening of said outlet ports.

7. A terminal unit according to claim 5, further comprising a stationary support fixed by a clamping member to said diffuser walls, having therethrough a screw for adjusting the minimum opening of the outlet ports of the diffuser and co-operating with said control lever.

8. A terminal unit according to claim 5, wherein said control lever is connected to the control rod through a tie rod and two cup-headed nuts forming a ball-joint linkage.

9. A terminal unit according to claim 1, wherein said device for conveying conditioned air directly to the thermostatic device comprises an inlet duct of conditioned air placed inside the diffuser and connected through a pressure switch to an outlet duct having its end directly opening into a sensing member of the thermostatic device.

10. A terminal unit according to claim 9, wherein said outlet duct is connected to said metal section through bellows members.

11. Terminal unit according to claim 10, wherein the thermostatic device is arranged inside the said hollow space formed on said metal section and is provided with at least one aperture to receive conditioned air from the bellows members.

12. A terminal unit according to claim 6, wherein the thermostatic device comprises, within a housing body fixed to the diffuser, at least one thermostatic element, such elements being in series there being provided between them and the housing body a spring adapted to take up further displacement of the thermostatic elements when said flow control means is in a position of maximum opening.

13. A terminal unit according to claim 12, wherein the thermostatic device includes another adjusting screw co-operating with said spring through a disc member.

* * * * *